US011120779B1

(12) United States Patent
Liao

(10) Patent No.: US 11,120,779 B1
(45) Date of Patent: Sep. 14, 2021

(54) STRUCTURE FOR ADJUSTING ANGLE OF PEDAL TO BE FOLDED OR UNFOLDED

(71) Applicant: Tsun-Chi Liao, Taichung (TW)

(72) Inventor: Tsun-Chi Liao, Taichung (TW)

( * ) Notice: Subject to any disclaimer, the term of this patent is extended or adjusted under 35 U.S.C. 154(b) by 0 days.

(21) Appl. No.: 17/117,176

(22) Filed: Dec. 10, 2020

(51) Int. Cl.
*G10D 13/11* (2020.01)
*G10D 13/063* (2020.01)

(52) U.S. Cl.
CPC ..... *G10D 13/11* (2020.02); *G10D 13/063* (2020.02)

(58) Field of Classification Search
CPC ..... G10D 3/00; G10D 13/11; G10D 13/063
See application file for complete search history.

(56) References Cited

U.S. PATENT DOCUMENTS 6,188,007 B1 2/2001 Liao
10,839,776 B1 11/2020 Liao
2016/0016636 A1* 1/2016 Thompson ..... B62M 6/90 74/594.7

* cited by examiner

*Primary Examiner* — Kimberly R Lockett
(74) *Attorney, Agent, or Firm* — Muncy, Geissler, Olds & Lowe, P.C.

(57) ABSTRACT

A structure for adjusting an angle of a pedal to be folded or unfolded includes a pedal seat, a rotating block and a locking element, wherein the pedal seat includes an upright post with a through lug, and the through lug is provided with a through hole, the rotating block includes a pivot hole to provide the through lug passing through and corresponding to the through hole, the rotating block and the upright post are provided with at least one contact surface, the rotating block and the upright post are respectively provided with at least one matched clamping structure to be correspondingly clamped at the at least one contact surface, the rotating block and the upright post are clamped by the locking element, so that matched clamping structures of the rotating block and matched clamping structures of the upright post are together engaged in a pairwise manner.

7 Claims, 5 Drawing Sheets

STRUCTURE FOR ADJUSTING ANGLE OF PEDAL TO BE FOLDED OR UNFOLDED

FIELD OF THE INVENTION

The invention relates to a pedal of a percussion instrument, in particular to a folding structure of the pedal.

BACKGROUND OF THE INVENTION

The brass cymbals are played by an upper and a lower brass cymbals knocking on each other. According to the prior art, the brass cymbals are arranged on the musical instrument stand and driven to knock on each other in a pedal treading manner so as to generate sound. Since the pedal and the instrument stand are L-shaped that take up a lot of space during storage, and are quite inconvenient during transportation, and may be likely damaged by accident.

Thus, U.S. Pat. No. 6,188,007B1 discloses a collapsible musical instrument pedal structure in which the pedal is collapsible parallel to the musical instrument stand and has a storage effect without occupying space.

U.S. Pat. No. 10,839,776 B1 discloses a rapidly collapsible musical instrument pedal structure in which a locking element is linked by a pressing lever, so that the locking element can be disengaged from or locked into a first hole or a second hole of a rotating block, and the rotating block can be rotated to a bending position or an upright position to fold or unfold the pedal.

However, the conventional pedal, when unfolded or folded, easily change the angle of the pedal due to an external force, which causes troubles in use or stowage.

SUMMARY OF THE INVENTION

Accordingly, it is a primary object of the present invention to disclose a structure that the angle of a pedal is fixed after being unfolded or folded.

In order to achieve the object, the invention discloses a structure for adjusting an angle of a pedal to be folded or unfolded, comprising a pedal seat, a rotating block and a locking element, wherein the pedal seat includes an upright post with a through lug, and the through lug is provided with a through hole passing through the through lug. The rotating block includes a pivot hole to provide the through lug passing through and corresponding to the through hole, the rotating block and the upright post are provided with at least one contact surface, and the rotating block and the upright post are respectively provided with at least one matched clamping structure to be correspondingly clamped at the at least one contact surface. The locking element passes through the through hole and the pivot hole, so that the rotating block is pivoted to the upright post and rotated to an upright position or a bending position, the rotating block and the upright post are clamped by the locking element, so that matched clamping structures of the rotating block and matched clamping structures of the upright post are together engaged in a pairwise manner.

Accordingly, the invention can be assembled for the pedal and a musical instrument stand, the pedal is in a folded or unfolded state relative to the musical instrument stand, an angle between the rotating block and upright post is fixed through the engagement of the matched clamping structures of the rotating block and the matched clamping structures of the upright post in a pairwise manner. Therefore, the use requirement can be met.

DETAILED DESCRIPTION OF THE PREFERRED EMBODIMENTS

The technical summary, features and efficacy of the present invention will be presented from the following detailed description of the preferred embodiments, taken in conjunction with the accompanying drawings.

Figure 1:
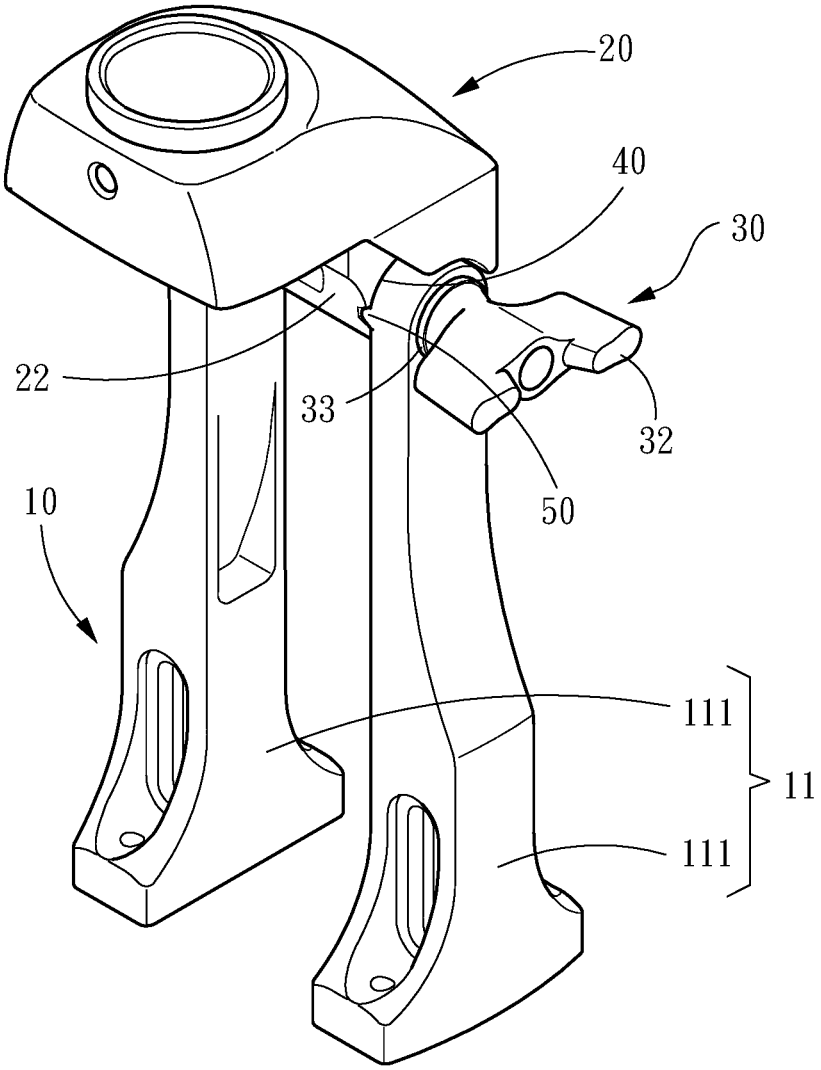
FIG. 1 is a perspective structure view of the present invention.
Figure 2:
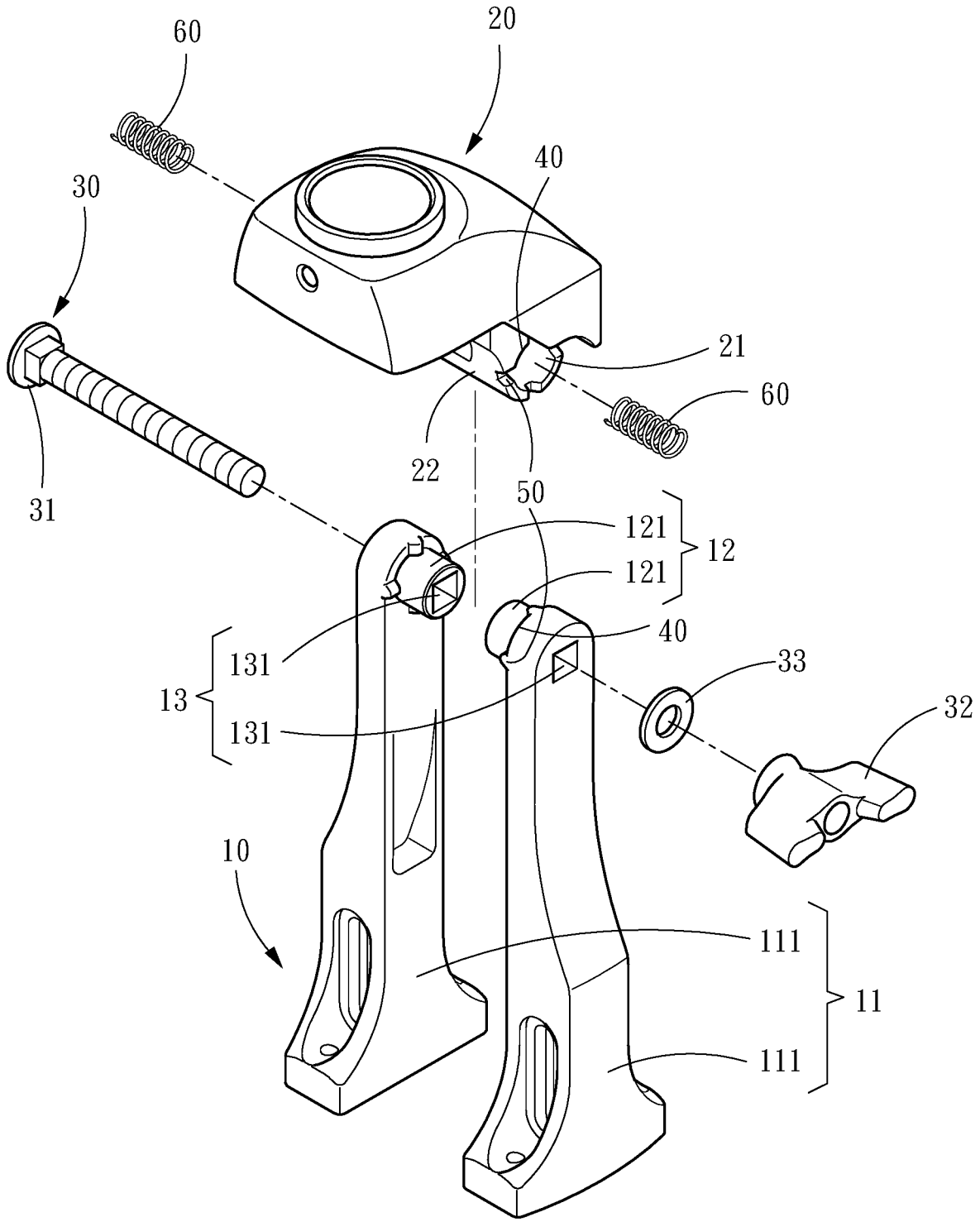
FIG. 2 is a perspective structure exploded view of the present invention.
Figure 3:
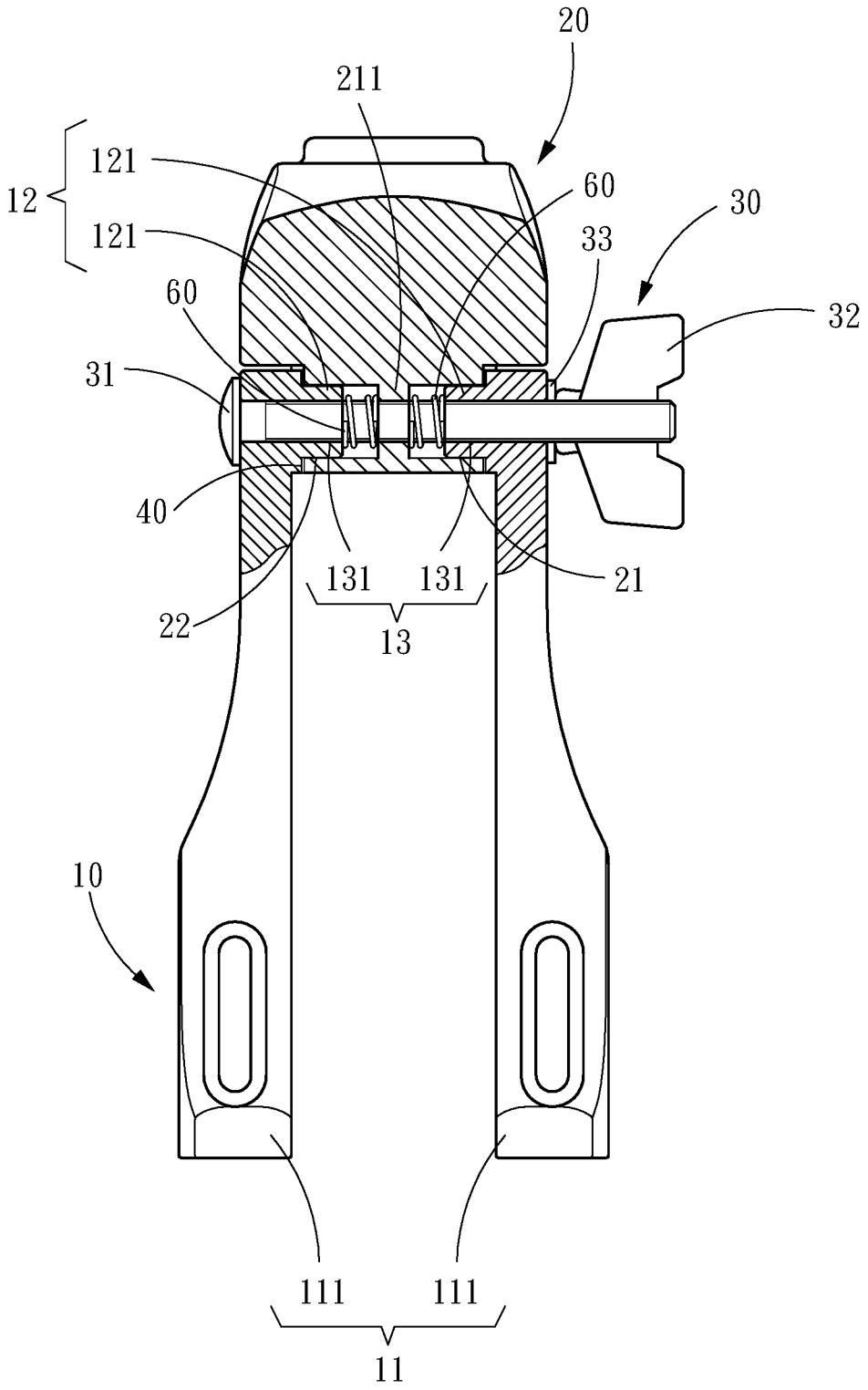
FIG. 3 is a sectional view of the rotating block of the present invention in an upright position.

Referring to FIG. 1, FIG. 2 and FIG. 3, the present invention discloses a structure for adjusting an angle of a pedal to be folded or unfolded, comprising a pedal seat 10, a rotating block 20 and a locking element 30, wherein the pedal seat 10 includes an upright post with a through lug 12, and the through lug 12 is provided with a through hole 13 passing through the through lug 12.

The rotating block 20 includes a pivot hole 21 to provide the through lug 12 passing through and corresponding to the through hole 13, the rotating block 20 and the upright post 11 are provided with at least one contact surface 40, the rotating block 20 and the upright post 11 are respectively provided with at least one matched clamping structure 50 to be correspondingly clamped at the at least one contact surface 40. In an embodiment, the upright post 11 may have two uprights 111, the through lug 12 includes two sub-through-lugs 121 respectively disposed on the two uprights 111, and the through hole 13 comprises two sub-through-holes 131 respectively disposed on the two sub-through-lugs 121, and the rotating block 20 includes a pivot block 22 extending between the two uprights 111, and the pivot hole 21 is formed in the pivot block 22.

The locking element 30 passes through the through hole 13 and the pivot hole 21, so that the rotating block 20 is pivoted to the upright post 11 and rotated to an upright position or a bending position. When the rotating block 20 rotates to the upright position or the bending position, the rotating block 20 and the upright post 11 are clamped by the locking element 30, so that matched clamping structures 50 of the rotating block 20 and matched clamping structures 50 of the upright post 11 are together engaged in a pairwise manner. In an embodiment, the locking element 30 includes a bolt 31 and a rotary knob 32, and the bolt 31 passes through the through hole 13 and the pivot hole 21 to be screwed on the rotary knob 32.

Figure 4:
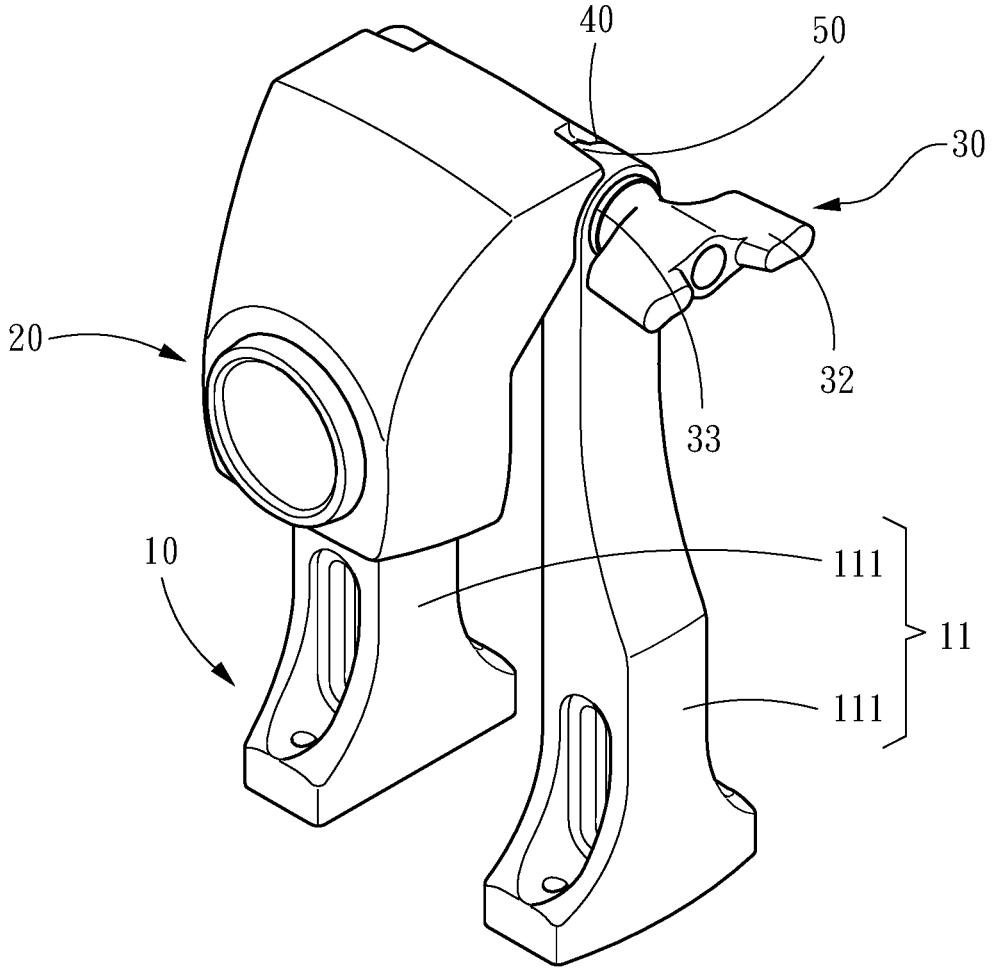
FIG. 4 is a perspective view of the rotating block according to the present invention in a bending position.

Referring to FIG. 3 and FIG. 4, the bolt 31 may be threaded through a baffle 33 adjacent to the rotary knob 32, thereby increasing rotation stability of the rotary knob 32. Moreover, a flange 211 is provided in the pivot hole 21, the bolt 31 is provided with two compression springs 60 which are respectively located at both sides of the flange 211, and the two compression springs 60 are pressed against both sides of the flange 211 and to press the two through lugs 12 and drive the two uprights 111 moving in a direction opposite to the flange 211. Therefore, when the locking element 30 is no longer clamping the rotating block 20 and the upright post 11, the clamping structures 50 of the rotating block 20 and the clamping structures 50 of the upright post 11 are loosened from engagement, so that a user can adjust the rotating block 20 to the upright position (shown in FIG. 1) or the bending position (shown in FIG. 4).

Figure 5:
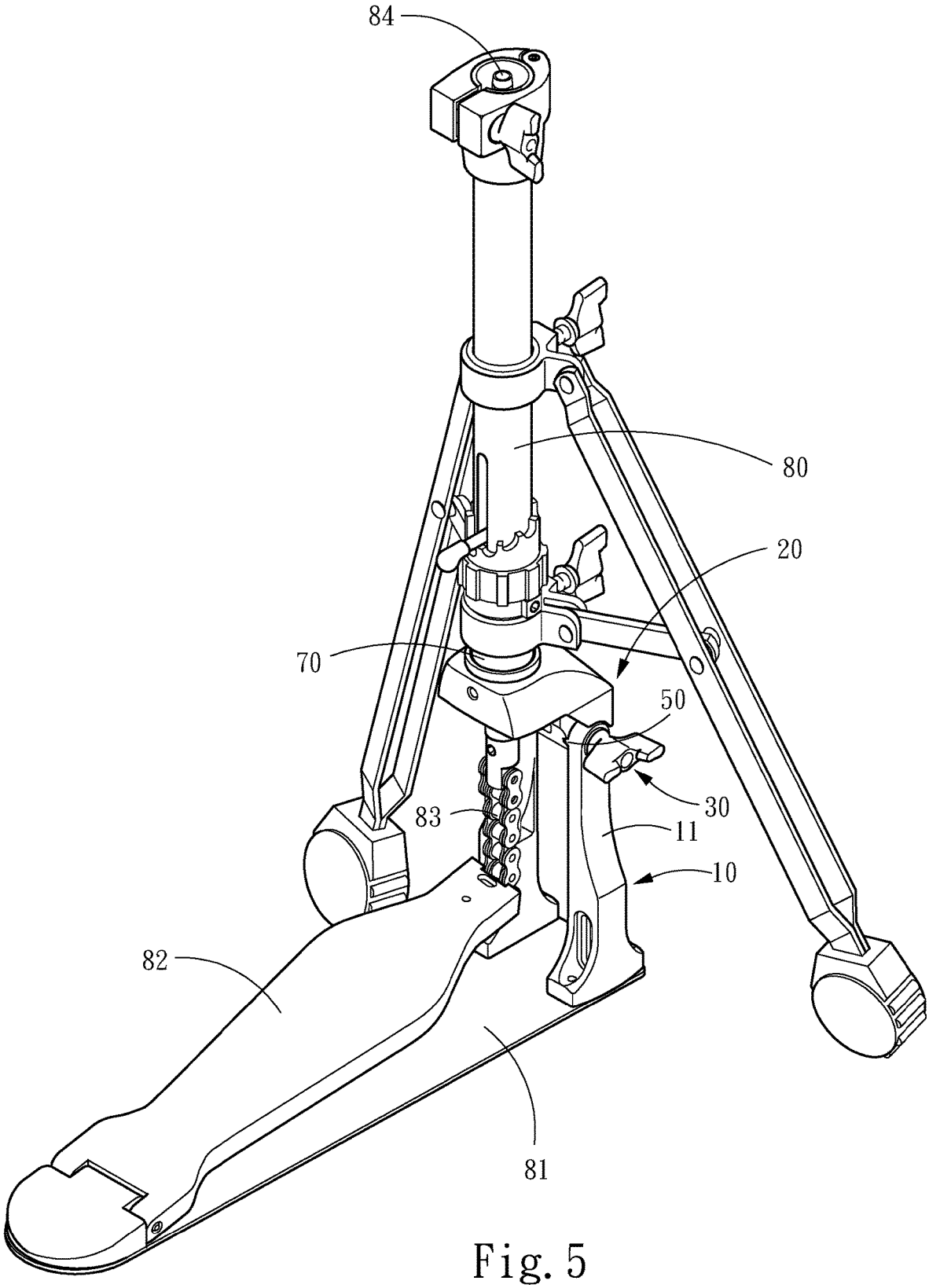
FIG. 5 is a structure diagram of an embodiment of the present invention.

Referring to FIG. 5, a structure diagram of an embodiment. When the rotating block 20 is in the upright position, the rotating block 20 may include an locking tube 70 which is disposed upwardly for locking a musical instrument stand 80, and the pedal seat 10 may be disposed on a pedal 81 which includes a treading plate 82. The treading plate 82 is connected with a driving rod 84 through a traction element 83, so that the driving rod 84 is displaced to drive the brass cymbals (not shown) to sound, and the pedal 81 is unfolded relative to the musical instrument stand 80. When not in use, the locking element 30 can be rotated to release the rotating block 20 and the upright post 11, and at the moment, the matched clamping structures 50 of the rotating block 20 and the clamping structures 50 of the upright post 11 are no longer engaged, so that the user can adjust the rotating block 20 to the bending position (as shown in FIG. 4) to enable the pedal 81 in a folding state relative to the musical instrument stand 80.

In summary, the invention has at least the following characteristics.

1. The rotating block and the upright post are clamped by the locking element. When the pedal is in a folded state or an unfolded state relative to the musical instrument stand, an angle between the rotating block and upright post is fixed through the engagement of the matched clamping structures 50 of the rotating block 20 and the matched clamping structures 50 of the upright post 11 in a pairwise manner.

2. The pedal is horizontally folded relative to the musical instrument stand, so that the problem of damage caused by falling down is avoided.

What is claimed is:

1. A structure for adjusting an angle of a pedal to be folded or unfolded, comprising:

a pedal seat, comprising an upright post with a through lug, wherein the through lug is provided with a through hole passing through the through lug;

a rotating block, comprising a pivot hole to provide the through lug passing through and corresponding to the through hole, wherein the rotating block and the upright post are provided with at least one contact surface, and the rotating block and the upright post are respectively provided with at least one matched clamping structure to be correspondingly clamped at the at least one contact surface; and a locking element, passing through the through hole and the pivot hole, so that the rotating block is pivoted to the upright post and rotated to an upright position or a bending position, the rotating block and the upright post are clamped by the locking element so that the at least one matched clamping structure of the rotating block and the at least one matched clamping structure of the upright post are together engaged in a pairwise manner.

2. The structure according to claim 1, wherein the upright post comprises two uprights, the through lug comprises two sub-through-lugs respectively disposed on the two uprights, and the through hole comprises two sub-through-holes respectively disposed on the two sub-through-lugs.

3. The structure according to claim 2, wherein the rotating block comprises a pivot block extending between the two uprights, and the pivot hole is formed in the pivot block.

4. The structure according to claim 3, wherein the locking element comprises a bolt and a rotary knob, and the bolt passes through the through hole and the pivot hole to be screwed on the rotary knob.

5. The structure according to claim 4, wherein the bolt is threaded through a baffle adjacent to the rotary knob.

6. The structure according to claim 4, wherein a flange is provided in the pivot hole, the bolt is provided with two compression springs which are respectively located at both sides of the flange, and the two compression springs are pressed against both sides of the flange to press the two through lugs and drive the two uprights moving in a direction opposite to the flange.

7. The structure according to claim 1, wherein the rotating block comprises an locking tube disposed upwardly when in the upright position.

* * * * *